US006776352B2

(12) United States Patent
Jameson

(10) Patent No.: US 6,776,352 B2
(45) Date of Patent: Aug. 17, 2004

(54) APPARATUS FOR CONTROLLABLY FOCUSING ULTRASONIC ACOUSTICAL ENERGY WITHIN A LIQUID STREAM

(75) Inventor: Lee Kirby Jameson, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 44 days.

(21) Appl. No.: 09/994,336

(22) Filed: Nov. 26, 2001

(65) Prior Publication Data

US 2003/0098364 A1 May 29, 2003

(51) Int. Cl.[7] ..... B05B 1/08; B05B 3/04; B05D 1/00

(52) U.S. Cl. ..... 239/1; 239/102.1; 239/102.2

(58) Field of Search ..... 239/1, 102.1, 102.2; 137/13, 827, 828; 251/129.06

(56) References Cited

U.S. PATENT DOCUMENTS 5,803,106 A * 9/1998 Cohen et al. ..... 239/102.2
6,010,592 A * 1/2000 Jameson et al. ..... 156/379.6

FOREIGN PATENT DOCUMENTS

| | | |
|---|---|---|
| EP | 0 640 374 A1 | 3/1995 |
| GB | 1 406 712 | 9/1975 |
| WO | 97/23280 | 7/1997 |

OTHER PUBLICATIONS

JP 04112784 (Abstract); Patent Assignee: Shimadzu Corp.; Apr. 14, 1992.
JP 09225400 (Abstract); Patent Assignee: Kaijo Corp.; Sep. 2, 1997.
JP 2002172389 (Abstract); Patent Assignee: Kobe Steel Ltd.; Jun. 18, 2002.

* cited by examiner

*Primary Examiner*—Robin O. Evans
(74) *Attorney, Agent, or Firm*—Scott B. Garrison

(57) ABSTRACT

An apparatus for controllably focusing ultrasonic acoustical energy to a desired position within a liquid stream by manipulation of the shape of a wave generator used to propagate acoustic energy as well as by the selection of the shape of a chamber within which the acoustic energy is applied to the liquid. When the ultrasonic acoustical wave generator is excited, it applies ultrasonic energy to the pressurized liquid contained within the chamber as the liquid passes through the housing without mechanically vibrating the exit orifice.

16 Claims, 9 Drawing Sheets

APPARATUS FOR CONTROLLABLY FOCUSING ULTRASONIC ACOUSTICAL ENERGY WITHIN A LIQUID STREAM

BACKGROUND OF THE INVENTION

The present invention relates to an apparatus for controllably focusing ultrasonic acoustical energy to a desired position within a liquid stream by manipulation of the shape of a wave generator used to propagate acoustic energy as well as by the selection of the shape of a chamber within which the acoustic energy is applied to the liquid. The controlled application of this energy allows one to change the properties of the stream, change the properties of constituents contained within the liquid stream, or both.

SUMMARY OF THE INVENTION

The present invention provides an apparatus for controllably focusing ultrasonic acoustical energy within a liquid stream. The apparatus consists of an ultrasonic acoustical wave generator that, when stimulated, emits ultrasonic acoustical energy in the form of vibrations from a tip. The tip is located at a distal end of the generator. The apparatus also has a chamber adapted to pass a liquid from the liquid stream therethrough. At least one acoustically reflective surface is located within the chamber for receiving the acoustical energy transmitted into the liquid stream from the tip of the generator and reflecting that energy to a desired position within the liquid stream to cause a desired effect on the stream.

In another embodiment, the apparatus is adapted to change the properties of the liquid stream itself by controllably focusing ultrasonic acoustical energy within that stream. This apparatus consists of an ultrasonic acoustical wave generator ending in the tip which is submerged in the liquid stream that, when stimulated, emits ultrasonic acoustical energy in the form of vibrations from a tip. A chamber is adapted to receive the liquid from the liquid stream and to enable the liquid to flow therethrough. The chamber has at least one acoustically reflective surface and an opening through which the ultrasonic acoustical energy is directed toward the acoustically reflective surface. The acoustically reflective surface reflects the energy to at least one desired focal point.

In another embodiment, the apparatus is adapted to change the properties of constituents contained within a liquid stream by controllably focusing ultrasonic acoustical energy within that stream. This apparatus has an ultrasonic acoustical wave generator terminating in a tip submerged in the liquid stream that, when stimulated, emits in a desired direction ultrasonic acoustical energy in the form of vibrations. A chamber having acoustically reflective walls is also provided. This chamber has an inlet adapted to receive the liquid from the liquid stream and an outlet adapted to pass the liquid to a position exterior to the chamber. The acoustically reflective walls serve to reflect the energy transmitted from the tip and focus that energy to a desired position within the liquid stream.

DEFINITIONS

As used herein, the term "liquid" refers to an amorphous (noncrystalline) form of matter intermediate between gases and solids, in which the molecules are much more highly concentrated than in gases, but much less concentrated than in solids. A liquid may have a single component or may be made of multiple components. The components may be other liquids, solids and/or gases. For example, a characteristic of liquids is their ability to flow as a result of an applied force. Liquids that flow immediately upon application of force and for which the rate of flow is directly proportional to the force applied are generally referred to as Newtonian liquids. Some liquids have abnormal flow response when force is applied and exhibit non-Newtonian flow properties.

As used herein, the term "node" or "nodal plane" means the point on the mechanical excitation axis of the ultrasonic acoustical wave generator at which no mechanical excitation motion of the wave generator occurs upon excitation by ultrasonic acoustical energy. The node sometimes is referred to in the art, as well as in this specification, as the nodal point or nodal plane.

The term "close proximity" is used herein in a qualitative sense only. That is, the term is used to mean that the ultrasonic acoustical wave generator is sufficiently close to the entrance of the chamber to apply the ultrasonic energy primarily to the reservoir of liquid contained within the chamber. The term is not used in the sense of defining specific distances from the chamber.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, catalysts, solvents, particulates and materials added to enhance processability of the composition.

DETAILED DESCRIPTION

Figure 1:
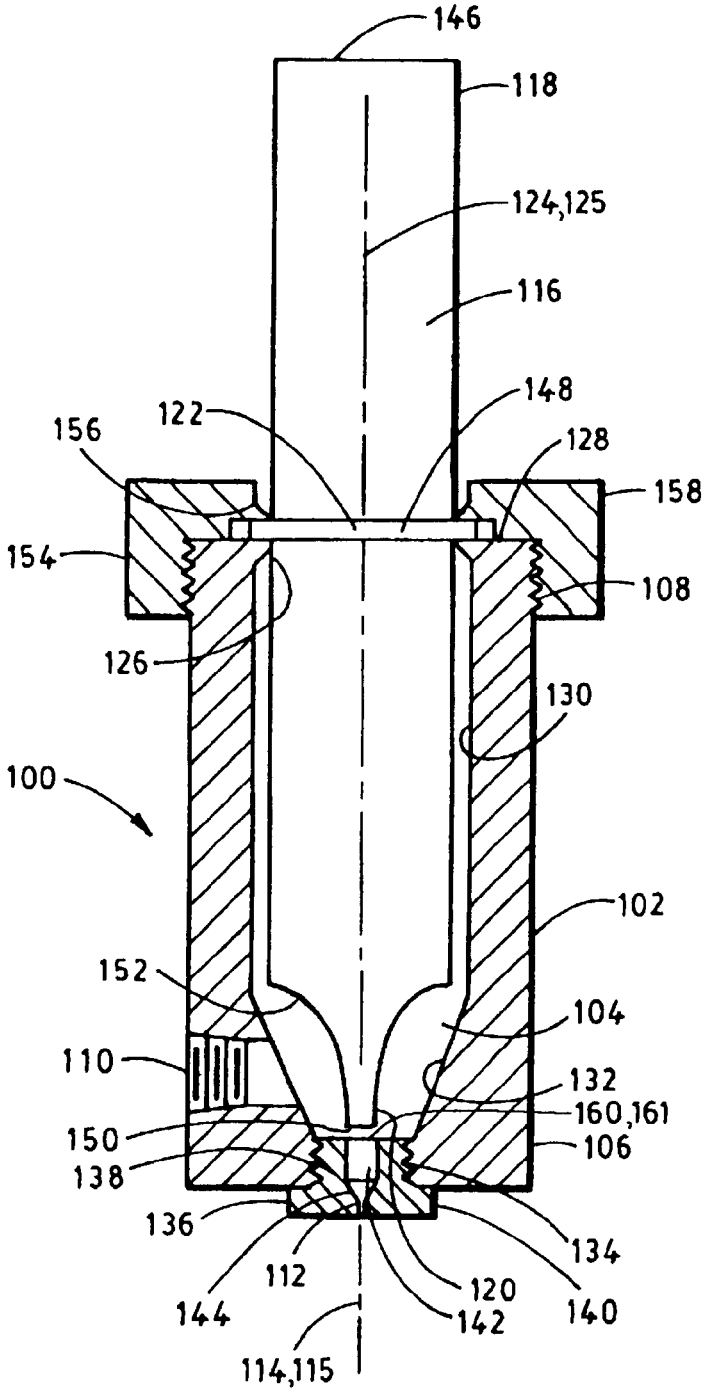
FIG. 1 is a diagrammatic cross-sectional representation of one embodiment of the apparatus of the present invention.

Generally speaking, FIG. 1 depicts the present invention comprising an apparatus 100 adapted to subject a liquid to focused ultrasonic acoustical energy as it is transferred through the apparatus 100 in the form of a stream. Looking to FIG. 1, there is shown, not necessarily to scale, an exemplary apparatus 100 for imparting ultrasonic vibrational energy to a desired position within the liquid stream.

In some embodiments, the apparatus 100 may be adapted to receive the liquid under pressure via an inlet 110. Such liquids include both Newtonian and non-Newtonian liquids. For example, these liquids could include paints, stains, epoxies, plastics, food products and syrups, emulsions, oil based liquids, aqueous liquids, molten metals, bituminous liquids, tars, in addition to others.

Figure 2:
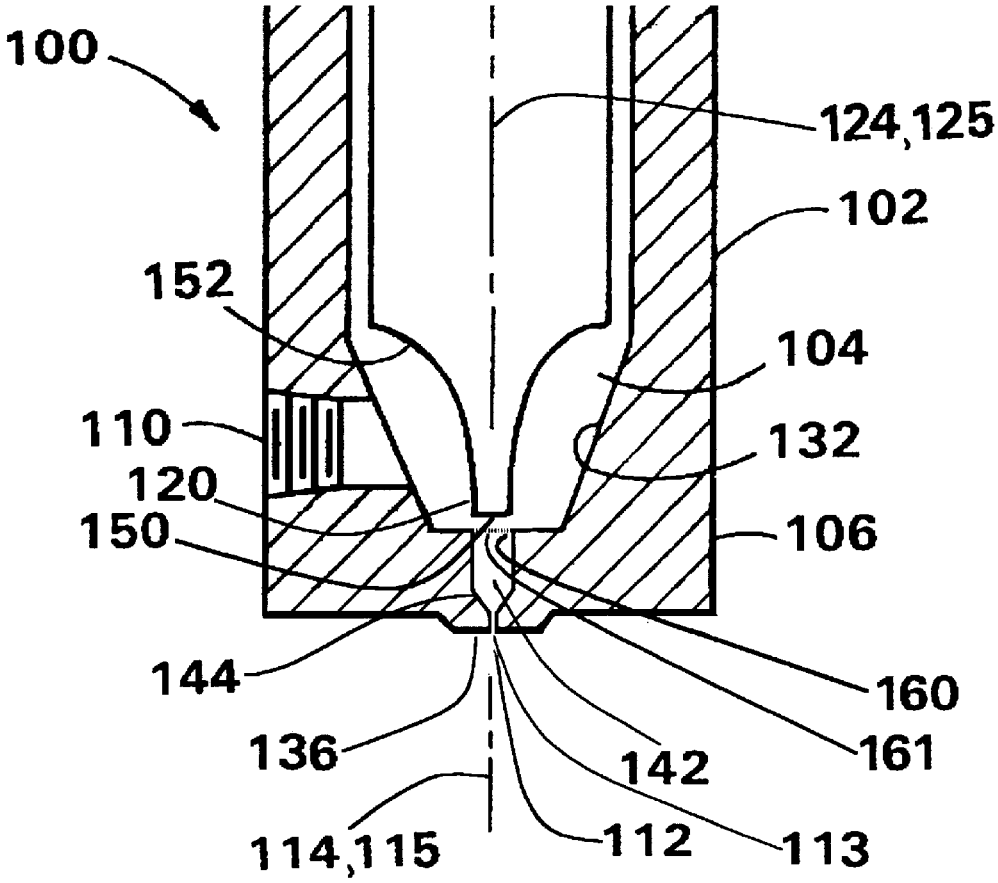
FIG. 2 is an enlarged view of an end of the FIG. 1 diagrammatic cross-section.

As depicted in FIGS. 1 and 2 embodiment, the apparatus 100 may comprise a housing 102 having a reservoir 104 which in some embodiments may be contained within the housing 102. A chamber 142 may be placed in contiguous communication with the reservoir 104. The chamber 142 may be provided with an entrance or entrances 160 having a cross-sectional area and a central axis 115 through the entrance 160 which in the FIG. 1 embodiment is normal to the cross-sectional area of the entrance 160. An exit orifice or orifices 112 may also be provided. The exit orifice 112 or orifices 112 lead from the chamber 142 to an exterior of the apparatus 100 and are adapted to pass the liquid out of the housing 102. The chamber 142 may be machined into the walls of the housing 102 or alternatively the housing 102 may comprise one or more sections (not shown) that when attached one to the other contain the inlet 110, exit orifice or orifices 112, reservoir 104, and chamber 142.

The housing 102 may have a first end 106 and a second end 108. The housing 102 may also comprise the inlet 110 which in turn is connected to the reservoir 104. The inlet 110 is adapted to supply the apparatus 100 and more specifically the chamber 142 via the reservoir 104 with the liquid to be subjected to the ultrasonic acoustical energy. The first end 106 of the housing 102 may terminate in a tip 136. The tip 136 may comprise a separate, interchangeable component as depicted in FIG. 1.

Alternatively, FIG. 2 depicts the tip 136 as an integral element of the housing 102. Moreover, the tip 136 is not required to protrude from the housing 102 as shown in FIGS. 1 and 2. The exit orifice 112 located in the tip 136 is adapted to receive the liquid from the chamber 142 and convey the liquid out of the housing 102.

Looking to FIG. 2 for additional detail, it can be seen that the chamber 142 may be disposed between the reservoir 104 and the exit orifice 112. In some embodiments, the chamber 142 serves as a point, volume, or region to which the energy is directed. However, in other embodiments explained below, the energy may be focused exterior to the chamber 142 and even exterior to the exit orifice 112. From the chamber 142, the liquid now excited by the application of ultrasonic energy is passed to and through the exit orifice 112. The chamber 142 may be directly connected to the exit orifice 112 or alternatively the two may be interconnected via tapered walls 144 which may form a part of the chamber 142 as shown in FIGS. 1 and 2.

Figure 3:
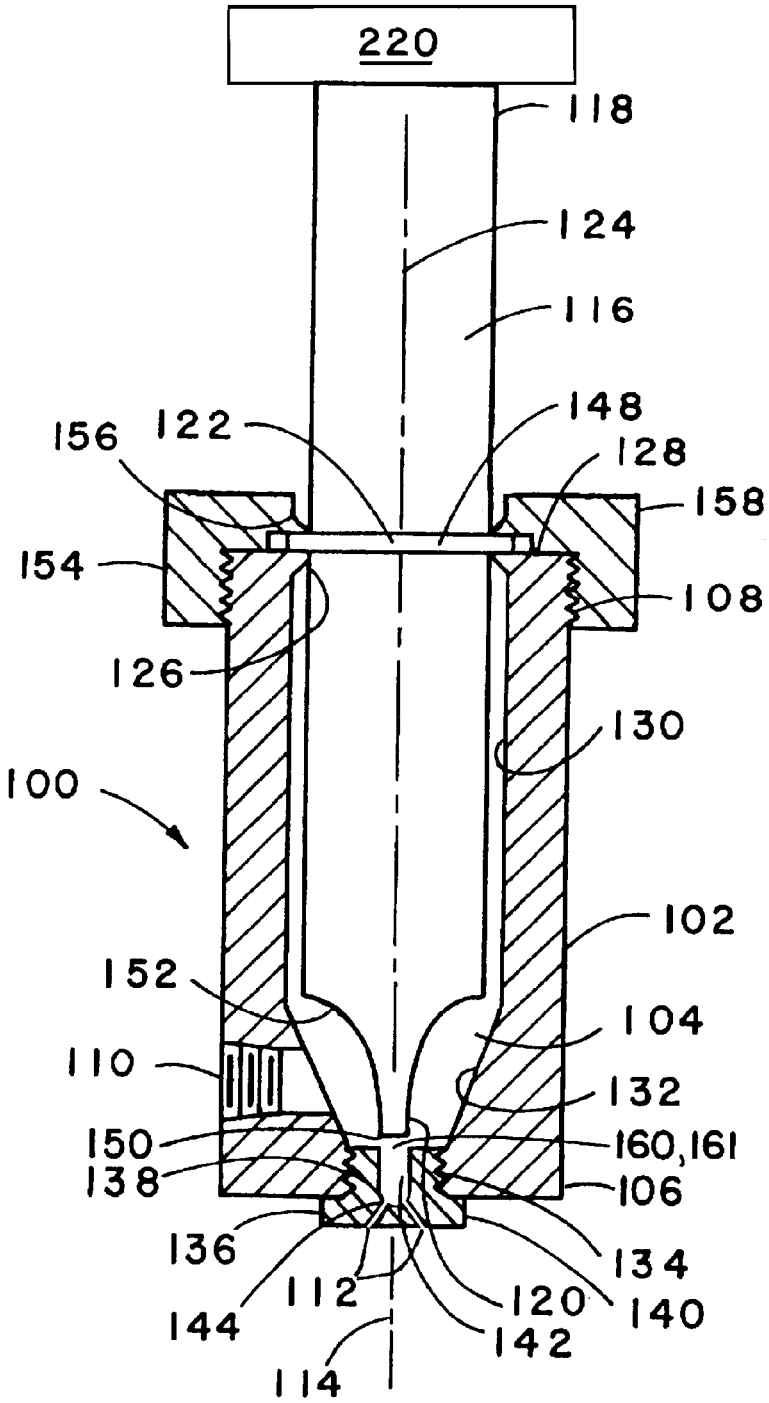
FIG. 3 is a diagrammatic cross-sectional representation of another embodiment of the apparatus of the present invention.

In some embodiments of the present invention, the exit orifice 112 may have a diameter of less than about 0.1 inch (2.54 mm). For example, the exit orifice 112 may have a diameter of from about 0.0001 to about 0.1 inch (0.00254 to 2.54 mm). As a further example, the exit orifice 112 may have a diameter of from about 0.001 to about 0.01 inch (0.0254 to 0.254 mm). The chamber 142 may have a diameter of about 0.125 inch (about 3.2 mm) terminating in the tapered walls 144 which in turn lead to the exit orifice 112. The tapered walls 144 may be frustoconical, however, other configurations are contemplated as well. For instance, the embodiment of FIG. 2 depicts tapered walls 144 having about a 30 degree convergence as measured from a central axis 115 through the tapered walls 144. Whereas the embodiment of FIG. 3 depicts a curved shape as measured from a central axis 115 through the tapered walls 144.

An ultrasonic acoustical wave generator, such as an ultrasonic horn 116 depicted in FIG. 1 is provided. The ultrasonic acoustical wave generator may comprise ultrasonic horn 116 as well as other ultrasonic acoustical wave generators The ultrasonic horn 116 of FIG. 1 has a first end 118, a second end 120, a nodal point or plane 122, a mechanical excitation axis 124, and a tip 150.

According to one aspect of the invention, the ultrasonic horn 116 may be affixed in a manner so that minimal vibrational energy is transferred to the housing 102, especially the exit orifice 112. To accomplish this, in some embodiments such as that shown in FIG. 1, the ultrasonic horn 116 may be affixed to the housing 102 at substantially the nodal plane 122 so that the only portion of the horn 116 to contact the housing 102 is that portion lying on the nodal plane 122. Additionally the horn 116 may be mounted so that the tip 150 resides within the reservoir 104. To ensure that the greatest quantity of ultrasonic acoustical energy is transferred into the liquid, the tip 150 of the ultrasonic horn 116 may comprise an area equal to the area defined by the entrance 160 of the chamber 142.

As shown in FIG. 1, the ultrasonic horn 116 may be located in the second end 108 of the housing 102 and fastened at its node 122 in a manner such that the first end 118 of the horn 116 is located outside of the housing 102 and the second end 120 is located inside the housing 102, within the reservoir 104, and in close proximity but not extending across an entrance plane 161 defined by the entrance 160 to the chamber 142.

Although not depicted, alternatively both the first end 118 and the second end 120 of the horn 116 may be located inside the housing 102 so long as the transfer of mechanical vibrational energy from the horn 116 to the housing 102 is minimized especially at the exit orifice 112.

Looking now to FIG. 2, the tip 150 of the ultrasonic horn 116 has a cross-sectional area. The chamber 142, as previously stated, has an entrance 160 having an entrance plane 161 with a corresponding cross-sectional area. In some desirable embodiments, a central axis 125 through the cross-sectional area of the tip 150 corresponds or is coincident with a longitudinal mechanical excitation axis 124, whereas a central axis 115 through the entrance plane 161 corresponds or is coincident with a first axis 114 through the chamber 142.

As shown in FIG. 2, the first axis 114 and the mechanical excitation axis 124 may be substantially coaxially aligned. The cross-sectional area of the tip 150 and the cross-sectional area of the entrance plane 161 may also be substantially equal in area as described above. In some embodiments, such as the FIG. 2 embodiment, the tip 150 or end of the horn 116 may be both coaxially aligned with and in parallel spaced relation to the entrance 160 to the chamber 142 and may be substantially in close proximity. This configuration serves to focus more of the vibrational energy into the liquid contained within the chamber 142.

Moreover, in some embodiments, such as those depicted in FIGS. 1–3, the first axis 114 and the mechanical excitation axis 124 of the ultrasonic horn 116 are substantially parallel. In some embodiments, the first axis 114 and the mechanical excitation axis 124 substantially coincide. In other embodiments, the first axis 114 and the mechanical excitation axis 124 actually coincide, as shown in FIGS. 1 and 2.

However, if desired, the mechanical excitation axis 124 of the horn 116 may be at some angle with respect to the first axis 114. For example, the horn 116 may extend through a wall 130 of the housing 102, (not shown) rather than through an end 106, 108. Moreover, neither the first axis 114 nor the mechanical excitation axis 124 of the horn 116 need be vertical.

As already noted, the term "close proximity" is used herein to signify that the ultrasonic acoustical wave generator or ultrasonic horn 116 depicted in the FIGS. is sufficiently close to the entrance plane 161 so as to apply the ultrasonic acoustical energy primarily to the liquid contained within the chamber 142 as the liquid stream passes from the chamber 142 into and through the exit orifice 112.

The actual distance between the tip 150 of the ultrasonic horn 116 and an exterior terminus 113 of the exit orifice 112 in any given situation will depend upon a number of factors, some of which are the flow rate and/or viscosity of the pressurized liquid, the cross-sectional area of the tip 150 of the ultrasonic horn 116 relative to the cross-sectional area of the exit orifice 112, the cross-sectional area of the tip 150 of the ultrasonic horn 116 relative to the cross-sectional area of the entrance plane 161 of the chamber 142, the frequency of the ultrasonic energy, the gain of the ultrasonic acoustical wave generator (e.g., the magnitude of the mechanical excitation of the ultrasonic horn 116), the temperature of the pressurized liquid, and the rate at which the liquid passes out of the exit orifice 112.

In general, the distance between the tip 150 of the ultrasonic horn 116 and the exterior terminus 113 of the exit orifice 112 in the first end 106 of the housing 102 in any given situation may be determined readily by one having ordinary skill in the art without undue experimentation. In practice, such distance may be in the range of from about 0.002 inch (about 0.05 mm) to about 1.3 inches (about 33 mm), although greater distances can be employed. Notwithstanding, the distance between the tip 150 of the ultrasonic horn 116 and the entrance plane 161 to the chamber 142 may range from about 0 inches (about 0 mm) to about 0.100 inch (about 2.5 mm).

The distance between the tip 150 of the ultrasonic horn 116 and the entrance plane 161 determines the extent to which energy is lost to the liquid contained within the reservoir 104. As such, the greater the distance between the tip 150 and the entrance plane 161, the greater the amount of energy lost to liquid not contained within the chamber 142.

Consequently, shorter distances may be desired in order to minimize energy losses, degradation of the pressurized liquid, and other adverse effects which may result from exposure of the liquid to the ultrasonic energy. In some embodiments, these distances range from about no protrusion of the tip 150 across the entrance plane 161 of the chamber 142 to about 0.010 inch (about 0.25 mm) separation between the tip 150 and the entrance plane 161. In at least one desirable embodiment, the tip 150 and the entrance plane 161 are separated by a distance of about 0.005 inch (about 0.13 mm).

In order to generate ultrasonic vibrations in the horn 116, the ultrasonic horn 116 itself may further comprise a vibrator 220, as depicted in FIG. 3, coupled to the first end 118 of the horn 116. The vibrator 220 may be a piezoelectric transducer or a magnetostrictive transducer.

The vibrator 220 may be coupled directly to the horn as shown in FIG. 3 or by means of an elongated waveguide (not illustrated). The elongated waveguide may have any desired in-put:output mechanical excitation ratio, although ratios of 1:1 and 1:1.5 are typical for many applications. The ultrasonic energy typically will have a frequency of from about 15 kHz to about 500 kHz, although other frequencies are contemplated as well. The vibrator 220 causes the horn 116 to vibrate along the mechanical excitation axis 124. In the present embodiment, the ultrasonic horn 116 will vibrate about the nodal plane 122 at the ultrasonic frequency that is applied to the first end 118 by the vibrator 220.

In some embodiments of the present invention, the ultrasonic horn 116 may be composed partially or entirely of a magnetostrictive material. In these embodiments, the horn 116 may be surrounded by a coil (which may also be immersed in the liquid) capable of inducing a signal into the magnetostrictive material causing it to vibrate at ultrasonic frequencies. In such cases, the ultrasonic horn 116 may simultaneously function as the vibrator 220 and the ultrasonic horn 116 itself. In any event, vibrational energy emanating from the tip 150 of the ultrasonic horn 116 when the horn 116 is activated is transferred to the liquid contained within the chamber 142.

FIGS. 4 through 7 depict possible embodiments of the chamber 142. Each of these FIGS. further depict the tip 150 of the ultrasonic acoustical wave generator. Acoustical energy symbolized by force lines 162 is depicted emanating from the tip 150. As shown, acoustical energy is reflected at a complementary angle off of reflective surfaces 164 which in this case are formed by the side walls of the chamber 142. More specifically, looking to FIG. 4, it is shown that the acoustical energy force lines 162 abide by the law of reflection which states that when a ray of energy reflects off of a surface, the angle of incidence $\Theta_I$ is equal to the angle of reflection $\Theta_R$. In other words, if a line N is drawn normal to a point on the reflective surface 164 impacted by a force line 162, then the angle at which the force line 162 impacts the surface 164 with respect to the line N or the angle of incidence $\Theta_I$ is equal to the angle at which the force line 162 is reflected from the surface 164 with respect to the same line N or the angle of reflection $\Theta_R$.

Figure 4:
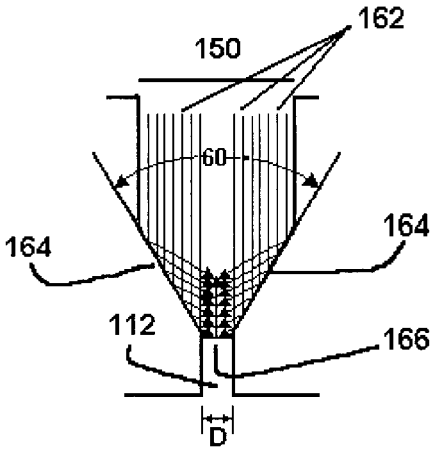
FIGS. 4–9 are diagrammatic cross-sectional representations of some possible chamber configurations.
Figure 5:
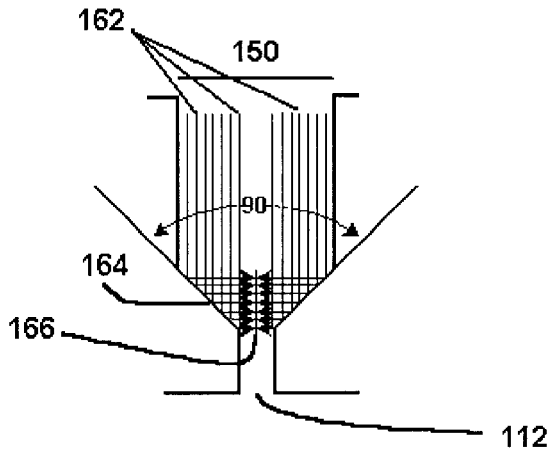
Figure 6:
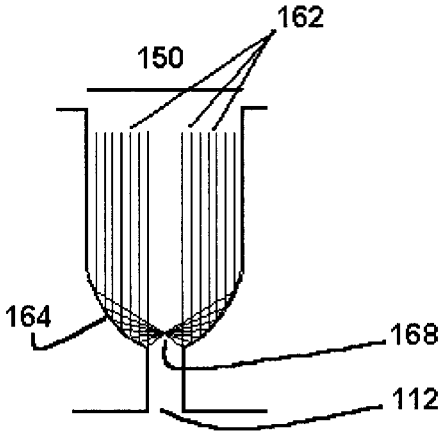
Figure 7:
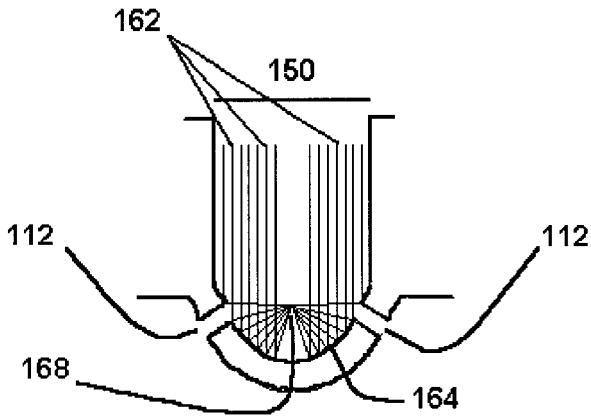

Dependent at least in part upon the configuration of the reflective surfaces 164 and the angle of incidence $\Theta_I$ at which the acoustical energy impacts the reflective surfaces 164, the energy can be focused to a desired point or region in the liquid stream. Looking to FIGS. 4 and 5, it is seen that reflective surfaces 164 when disposed in linear relation to the tip 150 will concentrate the energy into a central region within the chamber 142 forming a focal line 166 coincident with the axis 115 of the exit orifice 112. FIGS. 6 and 7, depict chambers 142 having curvilinear reflective surfaces 164 capable of concentrating the energy into a more focused area or point 168 coincident with the axis 115 of the exit orifice 112.

Figure 9:
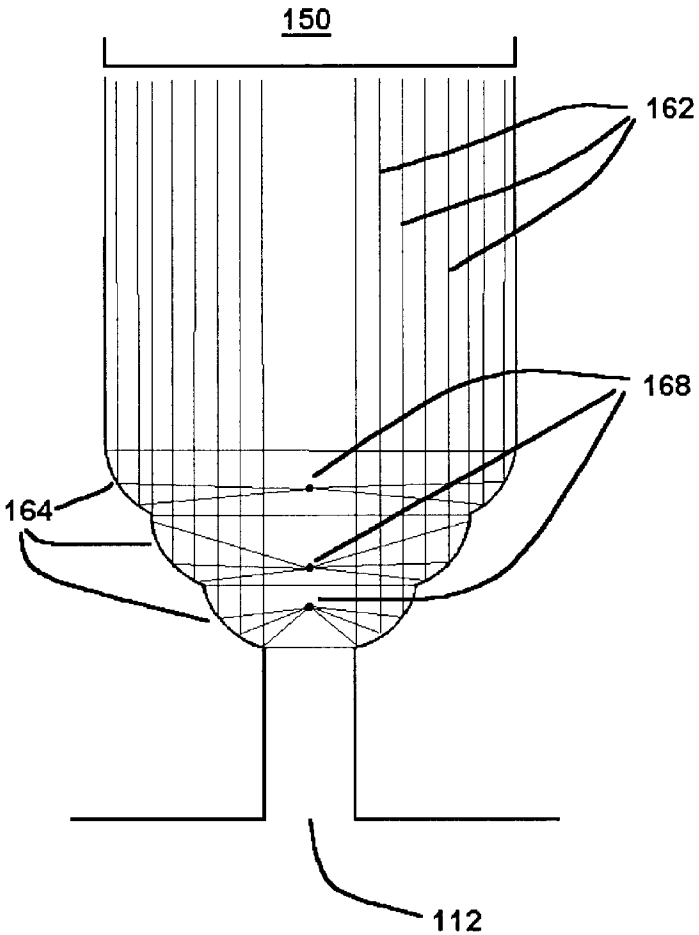
Figure 8:
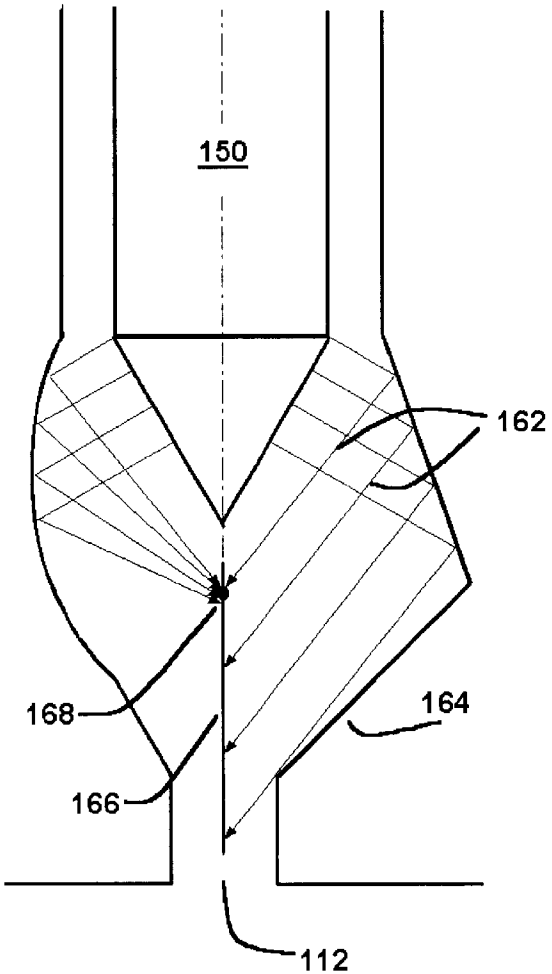

Though FIGS. 4 through 7 depict embodiments in which the shape of the chamber 142 is manipulated, FIG. 8 depicts an embodiment where the shape of the tip 150 of the ultrasonic acoustical wave generator is also altered to propagate ultrasonic acoustical energy in desired directions. By altering the shape of the tip 150, energy can be concentrated closer to or further away from the exit orifice 112 and may even be concentrated within the exit orifice as shown in FIG. 8. Configurations, which are not depicted, contemplate focal points 168 that may range beyond the exit orifice 112 to a point or region external to the housing 102. Moreover, the shape of the tip 150 of the ultrasonic acoustical wave generator and the reflective surfaces 164 may be selected together in order to obtain a desired effect. For instance, FIGS. 8 and 9 depict embodiments wherein the energy is focused to a plurality of focal points 168 as well as a focal line 166, all coincident with the axis of the exit orifice 112.

Manipulation of the reflective surfaces 164 and the tip 150 can be made to work together to establish various desirable effects on the liquid stream, for example to increase the flow rate of the liquid, to atomize the liquid, to emulsify the liquid, and/or to cavitate the liquid. Concentrating the energy into a focal line such as focal line 166 depicted in FIGS. 4 and 5 may be useful for subjecting constituents that may be contained within the stream to higher energy levels. For example, it may be desirable to subject contaminants, such as pathogens and particulate matter, contained within the stream to higher energy levels for longer periods of time, and focusing the energy into focal lines 166 allows for this. Alternatively, where a higher level of energy intensity is desired, focusing the energy to a point or points such as shown in FIGS. 5 and 6 may be desirable. For example, where it is desired to emulsify the liquid stream, or increase flow rate, focusing the energy into focal point 168 allows for this. Moreover, appropriate selection of foci within the chamber 142 can affect the degree of mixing, rarefaction, and atomization of the liquid stream.

In each of the depicted embodiments, the chamber walls act as reflective surfaces 164. However, other components such as baffles or additional walls (not shown) may be selectively placed in the chamber 142 to serve this function fully or in part. The invention further contemplates interchangeable user selectable ultrasonic wave generators and/or tips 150 configured to direct ultrasonic acoustical energy emanating from the tip 150 toward the appropriate direction or directions to accomplish the intended task. Also the invention contemplates interchangeable user selectable chambers 142 and/or reflective surfaces 164 to direct and reflect the ultrasonic acoustical energy in the appropriate direction or directions to accomplish the intended task.

In operation, the chamber 142 receives liquid directly from the reservoir 104 and passes it to the exit orifice 112 or exit orifices 112. The liquid contained within the chamber 142 is subjected to the ultrasonic acoustical energy supplied by the ultrasonic horn 116. During operation a small amount of energy may be lost to the liquid contained within the reservoir 104 itself but so long as the ultrasonic horn 116 is decoupled from the housing 102 or alternatively is secured to the housing 102 at the nodal plane 122, a very significant majority of the energy is directed into the liquid contained within the chamber 142 without significantly vibrating the exit orifice 112 itself. One manner of maximizing the energy transferred from the horn 116 into the liquid contained within the chamber 142 is to minimize or desirably eliminate any surface of the horn 116 from being perpendicular to the vibrational motion of the horn 116 itself, i.e., along the mechanical excitation axis 124, with the exception of the tip 150 of the horn 116 itself which serves as the input source of energy into the liquid. By the appropriate selection of the profile of the tip 150 with respect to the entrance 160 to the chamber 142 and placement of the reflective surfaces 164, the ultrasonic acoustical energy can be focused to the desired region in the liquid contained within the chamber 142 itself.

The size and shape of the apparatus 100 can vary widely, depending, at least in part, upon the number and arrangement of exit orifices 112 and the operating frequency of the ultrasonic horn 116. For example, the housing 102 may be cylindrical, rectangular, or any other shape. Moreover, since the housing 102 may have a plurality of exit orifices 112, the exit orifices 112 may be arranged in a pattern, including but not limited to, a linear or a circular pattern. Furthermore, the cross-sectional profile of the exit orifice 112 and the orientation of the exit orifice 112 with respect to the mechanical excitation axis 124 does not result in a negative impact on the use of the apparatus 100.

The application of ultrasonic energy to a plurality of exit orifices 112 may be accomplished by a variety of methods. For example, with reference again to FIG. 3, the second end 120 of the horn 116 may have a cross-sectional area which is sufficiently large so as to apply ultrasonic energy to the portion of the liquid in the vicinity of all of the exit orifices 112 in the housing 102.

One advantage of the apparatus 100 of the present invention is that it can be made to be self-cleaning. The combination of the pressure at which the liquid is supplied to the reservoir 104 and the forces generated by ultrasonically exciting the ultrasonic horn 116 can remove obstructions that appear to block the exit orifice 112 without significantly vibrating the housing 102 or the orifice exit 112.

According to the invention, the exit orifice 112 is adapted to be self-cleaning when the ultrasonic horn 116 is excited with ultrasonic energy while the exit orifice 112 receives pressurized liquid from the reservoir 104 via the chamber 142 and passes the liquid out of the housing 102. The vibrations imparted by the ultrasonic energy appear to change the apparent viscosity and flow characteristics of the high viscosity liquids.

Furthermore, the vibrations also appear to improve the flow rate of the liquids traveling through the apparatus 100 without increasing the pressure or temperature of the liquid supply. The vibrations cause breakdown and flushing out of clogging contaminants at the exit orifice 112. The vibrations can also cause emulsification of the liquid with other components (e.g., liquid components) or additives that may be present in the stream as well as enable additives and contaminants to remain emulsified in such liquids.

The present invention is further described by the example which follows. The example, however, is not to be construed as limiting in any way either the spirit or the scope of the present invention.

EXAMPLES

Ultrasonic Horn Apparatus

The following is a description of an exemplary ultrasonic horn apparatus of the present invention generally as shown in the FIGS. incorporating some of the features described above.

With reference to FIG. 1, the housing 102 of the apparatus was a cylinder having an outer diameter of 1.375 inches (about 34.9 mm), an inner diameter of 0.875 inch (about 22.2 mm), and a length of 3.086 inches (about 78.4 mm). The outer 0.312 inch (about 7.9 mm) portion of the second end 108 of the housing was threaded with 16-pitch threads. The inside of the second end had a beveled edge 126, or chamfer, extending from the face 128 of the second end toward the first end 106 a distance of 0.125 inch (about 3.2 mm). The chamfer reduced the inner diameter of the housing at the face of the second end to 0.75 inch (about 19.0 mm). An inlet 110 (also called an inlet orifice) was drilled in the housing, the center of which was 0.688 inch (about 17.5 mm) from the first end, and tapped. The inner wall of the housing consisted of a cylindrical portion 130 and a conical frustrum portion 132. The cylindrical portion extended from the chamfer at the second end toward the first end to within 0.992 inch (about 25.2 mm) from the face of the first end. The conical frustrum portion extended from the cylindrical portion a distance of 0.625 inch (about 15.9 mm), terminating at a threaded opening 134 in the first end. The diameter of the threaded opening was 0.375 inch (about 9.5 mm); such opening was 0.367 inch (about 9.3 mm) in length.

A tip 136 was located in the threaded opening of the first end. The tip consisted of a threaded cylinder 138 having a circular shoulder portion 140. The shoulder portion was 0.125 inch (about 3.2 mm) thick and had two parallel faces (not shown) 0.5 inch (about 12.7 mm) apart. An exit orifice 112 (also called an extrusion orifice) was drilled in the shoulder portion and extended toward the threaded portion a distance of 0.087 inch (about 2.2 mm). The diameter of the exit orifice was 0.0145 inch (about 0.37 mm). The exit orifice terminated within the tip at a chamber 142 having a diameter of 0.125 inch (about 3.2 mm) and conical frustum tapered walls 144 which joined the chamber with the exit orifice 112. The tapered walls 144 were at an angle of 30° from the vertical. The chamber 142 extended from the exit orifice 112 to the entrance plane 161, thereby connecting the reservoir 104 defined by the housing 102 with the exit orifice 112.

The ultrasonic acoustical wave generator was a cylindrical ultrasonic horn 116. The horn was machined to resonate at a frequency of 20 kHz. The horn had a length of 5.198 inches (about 132.0 mm), which was equal to one-half of the resonating wavelength, and a diameter of 0.75 inch (about 19.0 mm). The face 146 of the first end 118 of the horn 116 was drilled and tapped for a ⅜-inch (about 9.5-mm) stud (not shown). The horn 116 was machined with a collar 148 at the nodal point 122. The collar was 0.094-inch (about 2.4-mm) wide and extended outwardly from the cylindrical surface of the horn 0.062 inch (about 1.6 mm). The horn 116 was affixed to the housing 102 at the collar 148. By affixing the horn to the housing at the nodal point of the horn, the transfer of vibrational energy to the housing was eliminated or at least substantially minimized. The diameter of the horn 116 at the collar was 0.875 inch (about 22.2 mm). The second end 120 of the horn terminated in a small cylindrical tip 150 0.125 inch (about 3.2 mm) long and 0.125 inch (about 3.2 mm) in diameter. Such tip 150 was separated from the cylindrical body of the horn by a parabolic frustrum portion 152 approximately 0.5 inch (about 13 mm) in length. That is, the curve of this frustrum portion as seen in cross-section was parabolic in shape. The face of the small cylindrical tip 150 was normal to the cylindrical wall of the horn and was located about 0.005 inch (about 0.13 mm) from the plane across the entrance to the chamber. Thus, the face of the tip of the horn, i.e., the second end of the horn 150, was located immediately above the entrance to the chamber and was the same area as the planar area across the entrance of the chamber.

The second end 108 of the housing was sealed by a threaded cap 154 which also served to hold the ultrasonic horn in place. The threads extended upwardly toward the top of the cap a distance of 0.312 inch (about 7.9 mm). The outside diameter of the cap was 2.00 inches (about 50.8 mm) and the length or thickness of the cap was 0.531 inch (about 13.5 mm). The opening in the cap was sized to accommodate the horn; that is, the opening had a diameter of 0.75 inch (about 19.0 mm). The edge of the opening in the cap was a chamfer 156 which was the mirror image of the chamfer at the second end of the housing. The thickness of the cap at the chamfer was 0.125 inch (about 3.2 mm), which left a space between the end of the threads and the bottom of the chamfer of 0.094 inch (about 2.4 mm), which space was the same as the length of the collar on the horn. The diameter of such space was 1.104 inch (about 28.0 mm). The top 158 of the cap had drilled in it four ¼-inch diameter ×¼-inch deep holes (not shown) at 90° intervals to accommodate a pin spanner. Thus, the collar of the horn was compressed between the two chamfers upon tightening the cap, thereby sealing the reservoir defined by the housing.

A Branson elongated aluminum waveguide having an input:output mechanical excitation ratio of 1:1.5 was coupled to the ultrasonic horn by means of a ⅜-inch (about 9.5-mm) stud. To the elongated waveguide was coupled a piezoelectric transducer, a Branson Model 502 Converter, which was powered by a Branson Model 1120 Power Supply operating at 20 kHz (Branson Sonic Power Company, Danbury, Conn.). Power consumption was monitored with a Branson Model A410A Wattmeter.

Example 1

Two configurations of the tip 136 were tested to determine the effects of ultrasonic acoustical energy upon flow rate, atomized particle size, and particle velocity. The first configuration is identical to the FIG. 4 depiction. Two different tips having this configuration were actually tested. These tips are labeled as nozzle #3 and nozzle #4.

Each tip or nozzle was identical in all dimensions with the exception that the exit orifice 112 of nozzle #3 was a capillary having a diameter "D" as shown on FIG. 4 of 0.006 inch (about 0.15 mm) whereas the exit orifice of nozzle #4 was a capillary having a diameter "D" of 0.008 inch (about 0.20 mm).

The FIG. 7 drawing is similar to the second configuration with the exception that for the tests the tip 136 had only a single exit orifice 112 in lieu of the two depicted in FIG. 7. This second configuration was labeled the "EMD nozzle" for test purposes.

The instrument used to determine the particle size and velocity of the liquid was the Aerometrics phase-doppler particle analyzer. Flow rates were determined using standard rotometers. The liquid used for testing was Number 2 diesel fuel having a density of 0.81 g/ml and a viscosity of 2.67 centistokes.

Data was taken at pressures of 250, 1,000 and 2,000 psi with ultrasonic power both on and off. A table of the results from these tests may be found below at Table I. The column labeled "Resultant Force (N/1000)" is calculated from velocity and mass flow rate readings.

TABLE 1

SUMMARY OF RESULTS FOR FINAL PHASE OF AEROMETRICS TESTING

| Nozzle No. | Hole Diameter (in) | Fluid Pressure (PSIG) | Ultrasound Power (VA) | Flow Rate (g/min) | SMD (um) | Mean Velocity (m/s) | Resultant Force (N/1000) |
|---|---|---|---|---|---|---|---|
| 3 | 0.006 | 250 | 0 | 99.8 | 61.79 | 11.43 | 19.0 |
| 3 | 0.006 | 250 | 18.2 | 89.2 | 53.79 | 17.60 | 26.2 |
| 3 | 0.006 | 1000 | 0 | 142.1 | 41.77 | 15.00 | 35.5 |
| 3 | 0.006 | 1000 | 82.9 | 136.1 | 53.84 | 20.10 | 45.6 |
| 3 | 0.006 | 2000 | 0 | 175.4 | 54.94 | 20.27 | 59.3 |

TABLE 1-continued

SUMMARY OF RESULTS FOR FINAL PHASE OF AEROMETRICS TESTING

| Nozzle No. | Hole Diameter (in) | Fluid Pressure (PSIG) | Ultrasound Power (VA) | Flow Rate (g/min) | SMD (um) | Mean Velocity (m/s) | Resultant Force (N/1000) |
|---|---|---|---|---|---|---|---|
| 3 | 0.006 | 2000 | 79.3 | 175.4 | 56.63 | 26.85 | 78.5 |
| 4 | 0.008 | 250 | 0 | 124.0 | 93.75 | 14.53 | 30.0 |
| 4 | 0.008 | 250 | 9.7 | 99.8 | 32.40 | 28.27 | 47.0 |
| 4 | 0.008 | 1000 | 0 | 169.3 | 35.32 | 28.84 | 81.4 |
| 4 | 0.008 | 1000 | 140.0 | 169.3 | 34.48 | 32.28 | 91.1 |
| EMD | 0.013 | 250 | 0 | 128.5 | 57.54 | 18.67 | 40.0 |
| EMD | 0.013 | 250 | 362.0 | 133.1 | 69.33 | 29.27 | 64.9 |
| EMD | 0.013 | 1000 | 0 | 196.6 | 64.80 | 22.72 | 74.4 |
| EMD | 0.013 | 1000 | 829.0 | 208.7 | 59.10 | 43.97 | 152.9 |

Figure 10:
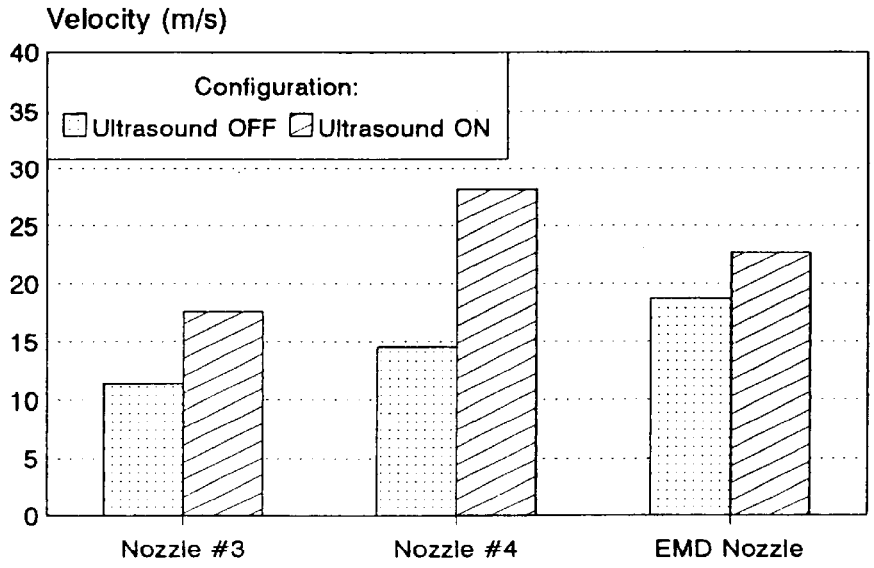
FIG. 10 is a graph depicting the effects of ultrasonic acoustical energy on droplet velocity at 250 PSIG.
Figure 11:
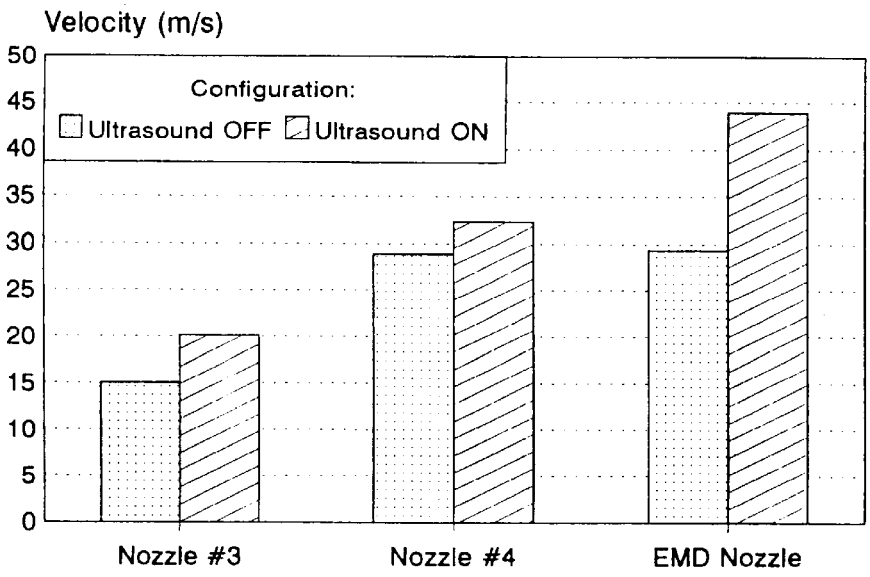
FIG. 11 is a graph depicting the effects of ultrasonic acoustical energy on droplet velocity at 1000 PSIG.

A significant measurement, droplet velocity, labeled "mean velocity" above is provided by the Aerometrics unit. The increase in velocity due to ultrasound is significant and consistent regardless of pressure. The increase is between 20 and 30 percent with nozzle #3, as shown. A further comparison of velocity effects with different nozzles at 250 and 1000 PSIG is shown in FIGS. 10 and 11, respectively. In each case, the application of ultrasound increased the droplet velocity. The EMD injector nozzle showed the most significant increase in velocity, and did so at the higher injection pressure.

Figure 12:
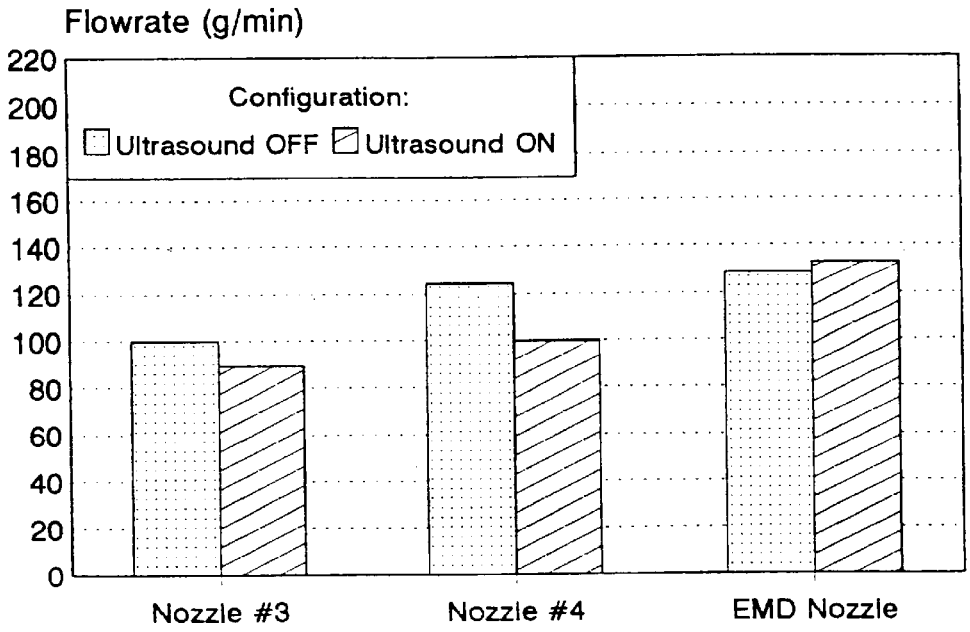
FIG. 12 is a graph depicting the effects of ultrasonic acoustical energy on flow rate at 250 PSIG.
Figure 13:
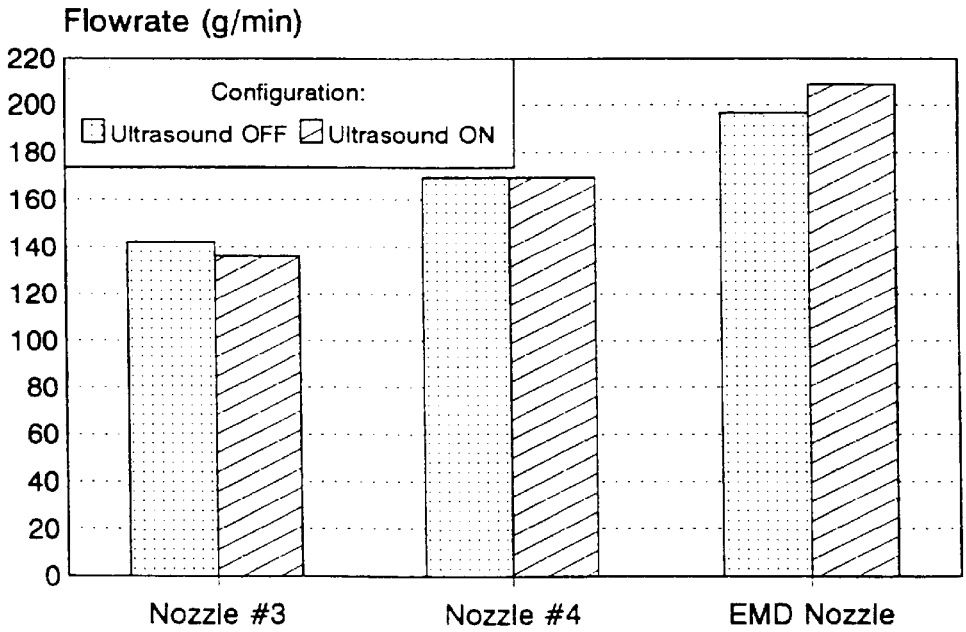
FIG. 13 is a graph depicting the effects of ultrasonic acoustical energy on flow rate at 1000 PSIG.

At higher injection pressures, the flow rate with ultrasound applied approaches the flow rate for the normal condition. FIGS. 12 and 13 show flow rate for the 250 and 1000 PSIG tests with different nozzles. When ultrasound is applied at higher pressures, it was found that the flow rate tends to increase as nozzle size is increased. The EMD nozzle showed a significant increase in flow rate when ultrasound was applied. This was verified through repeat testing, as the flowmeter would jump up immediately when the ultrasound power switch was turned on.

Figure 14:
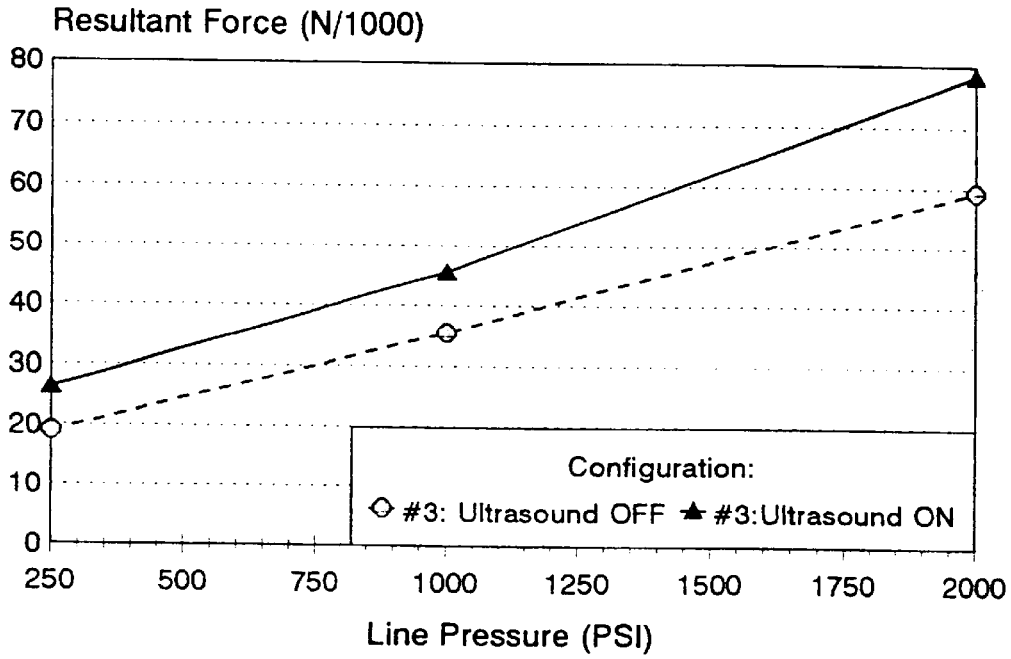
FIG. 14 is a graph depicting the effects that pressure has on resultant force.
Figure 15:
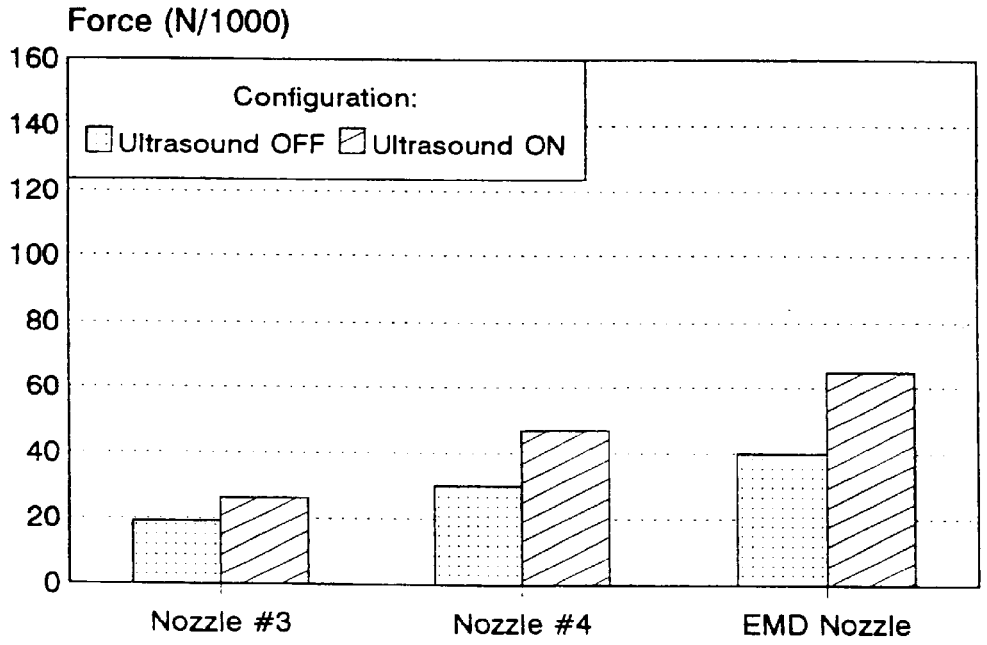
FIG. 15 is a graph depicting the effects of ultrasonic acoustical energy on resultant force at 250 PSIG.
Figure 16:
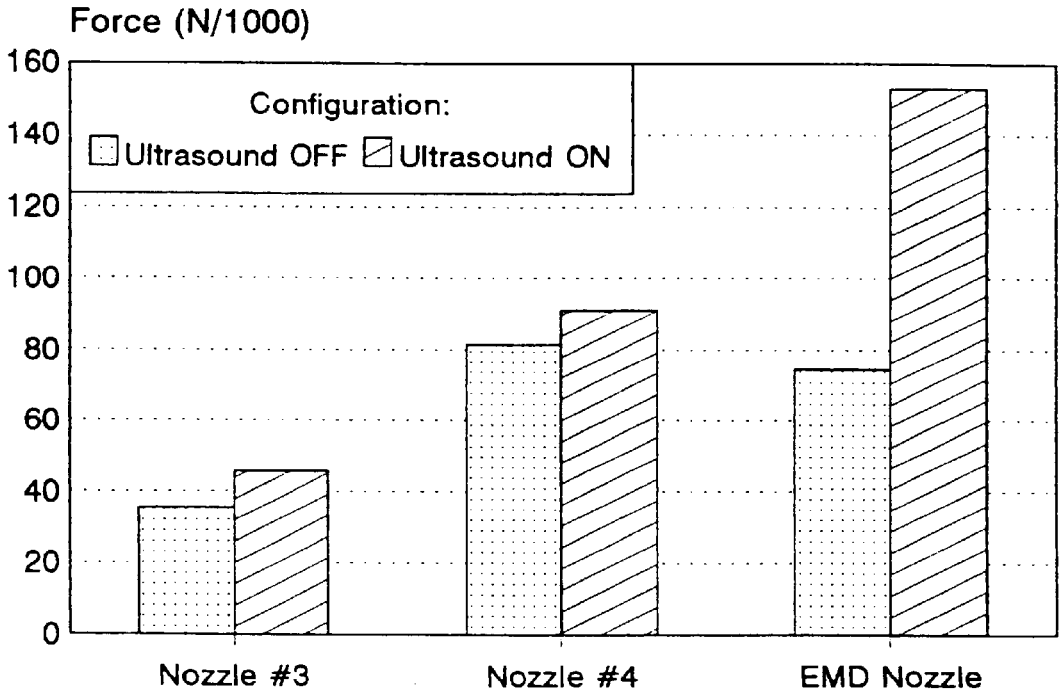
FIG. 16 is a graph depicting the effects of ultrasonic acoustical energy on resultant force at 1000 PSIG.

FIG. 14 shows the calculated resultant force in Newtons $\times 10^{-3}$ for nozzle #3. The resultant force in Newtons can be obtained by multiplying the velocity by the flow rate. It was found that the addition of ultrasound to the spray yields a higher resultant force at all conditions, and the increase is greater as the pressure rises. This effect was also noted with other nozzle configurations. FIGS. 15 and 16 show the resultant force for the three nozzles at 250 and 1000 PSIG, respectively. The largest increase in resultant force occurs with the EMD nozzle at the 1000 PSIG condition. This indicates that a significant amount of ultrasonic energy has been transferred from the ultrasonic horn to the spray.

Both Table I and the graphs of FIGS. 12 and 13 indicate that in both tip configurations numbered 3 and 4 that liquid flow rate remains the same or is reduced with the application of ultrasound. Under the same conditions, however, the flow rate increases through the tip EMD nozzle, indicating that the ultrasonic acoustical energy is being more efficiently transferred to the liquid in a tip having reflective surfaces 164 similar to those as illustrated in FIG. 7.

Related Patents and Applications

This application is one of a group of commonly assigned patents and patent applications. The group includes application Ser. No. 08/576,543 entitled "An Apparatus And Method For Emulsifying A Pressurized Multi-Component Liquid", in the name of L. K. Jameson et al.; application Ser. No. 08/576,536, now granted U.S. Pat. No. 6,053,424, entitled "An Apparatus And Method For Ultrasonically Producing A Spray Of Liquid", in the name of L. H. Gipson et al.; application Ser. No. 08/576,522 entitled "Ultrasonic Fuel Injection Method And Apparatus", in the name of L. H. Gipson et al.; application Ser. No. 08/576,174, now granted U.S. Pat. No. 5,803,106, entitled "An Ultrasonic Apparatus And Method For Increasing The Flow Rate Of A Liquid Through An Orifice", in the name of B. Cohen et al.; and application Ser. No. 08/576,175, now granted U.S. Pat. No. 5,868,153, entitled "Ultrasonic Flow Control Apparatus And Method", in the name of B. Cohen et al.; provisional application 60/254,737 entitled "Ultrasonic Fuel Injector with Ceramic Valve Body", in the name of Jameson et al.; provisional application 60/254,683 entitled "Unitized Injector Modified for Ultrasonically Stimulated Operation", in the name of Jameson et al.; provisional application 60/257,593 entitled "Ultrasonically Enhanced Continuous Flow Fuel Injection Apparatus and Method", in the name of Jameson et al.; and provisional application 60/258,194 entitled "Apparatus and Method to Selectively Microemulsify Water and Other Normally Immiscible Fluids into the Fuel of Continuous Combustors at the Point of Injection", in the name of Jameson et. al. The subject matter of each of these applications is hereby incorporated by reference.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method for controllably focusing energy in a liquid medium comprising:

providing an ultrasonic horn having a removable tip;

inducing the tip to vibrate ultrasonically at a first energy level;

providing a user selectable chamber adapted to pass a liquid therethrough, the chamber comprising acoustically reflective walls shaped to reflect energy directed toward the walls from the horn tip to at least one focal point within the liquid thereby increasing the energy at the at least one focal point to a second energy level greater than the first energy level.

2. The method of claim 1 comprising focusing the energy to a single focal point.

3. The method of claim 1 comprising focusing the energy to a plurality of foci.

4. The method of claim 3 wherein the foci are linearly spaced one from another.

5. The method of claim 1 comprising focusing the energy to the at least one focal point within the chamber.

6. The method of claim 1 comprising focusing the energy to the at least one focal point exterior to the chamber.

7. The method of claim 1 comprising focusing the energy to a plurality of foci at least some of which are located within the chamber.

8. The method of claim 1 comprising selecting the chamber to have parabolically shaped walls.

9. The method of claim 1 comprising selecting the chamber to have frustoconical shaped walls.

10. A method for transferring energy into a liquid medium comprising:

passing a liquid through a system under pressure at a desired flow rate;

directing energy emanating from an ultrasonic energy source having user interchangeable tips toward at least one acoustically reflective surface at a plurality of incidence angles, the energy emanating from the source at a first energy level;

reflecting the energy from the reflective surface to at least one focal point, wherein the energy at the at least one focal point comprises a second energy level greater than the first energy level.

11. The method of claim 10 comprising providing a chamber for receiving and storing a portion of the liquid during its transit through the system, wherein the chamber forms at least some portion of the reflective surface.

12. The method of claim 10 comprising focusing the energy to a single focal point.

13. The method of claim 10 comprising focusing the energy to a plurality of foci.

14. The method of claim 11 wherein the foci are linearly spaced from one another.

15. The method of claim 11 comprising selecting the chamber to have parabolically shaped walls.

16. The method of claim 11 comprising selecting the chamber to have frustoconical shaped walls.

* * * * *